US006255594B1

(12) United States Patent
Hudson

(10) Patent No.: US 6,255,594 B1
(45) Date of Patent: Jul. 3, 2001

(54) COMMUNICATIONS CABLE

(75) Inventor: Martin Frederick Arthur Hudson, Hampshire (GB)

(73) Assignee: Plastic Insulated Cables Limited, Andover (GB)

( * ) Notice: Subject to any disclaimer, the term of this patent is extended or adjusted under 35 U.S.C. 154(b) by 0 days.

(21) Appl. No.: 09/297,424

(22) PCT Filed: Apr. 9, 1998

(86) PCT No.: PCT/GB98/01069

§ 371 Date: Jun. 9, 1999

§ 102(e) Date: Jun. 9, 1999

(87) PCT Pub. No.: WO98/45855

PCT Pub. Date: Oct. 15, 1998

(30) Foreign Application Priority Data

Apr. 10, 1997 (GB) ..... 9707300

(51) Int. Cl.[7] ..... H01B 11/02
(52) U.S. Cl. ..... 174/121 A
(58) Field of Search ..... 174/110 R, 110 F, 174/110 PM, 113 R, 121 A, 36, 110 V, 121 R, 122 G; 428/379, 375, 377, 372, 378

(56) References Cited

U.S. PATENT DOCUMENTS

| | | | | |
|---|---|---|---|---|
| 4,280,225 | | 7/1981 | Willis | 455/55 |
| 4,284,842 | | 8/1981 | Arroyo et al. | 174/107 |
| 4,604,497 | * | 8/1986 | Bell et al. | 174/110 F |
| 4,605,818 | | 8/1986 | Arroyo et al. | 174/107 |
| 4,810,835 | | 3/1989 | Richter et al. | 174/107 |
| 4,849,135 | | 7/1989 | Reitz | 252/606 |
| 5,216,202 | * | 6/1993 | Yoshida et al. | 174/36 |
| 5,600,097 | * | 2/1997 | Bleich et al. | 174/110 R |
| 5,841,073 | * | 11/1998 | Randa et al. | 174/113 R |

FOREIGN PATENT DOCUMENTS

| | | |
|---|---|---|
| 3044871 | 6/1986 | (DE) . |
| 3833597 | 4/1990 | (DE) . |
| 0260373 | 3/1987 | (EP) . |
| 0107796 | 7/1987 | (EP) . |
| 0268827 | 6/1988 | (EP) . |
| 0106708 | 5/1989 | (EP) . |
| 0203129 | 5/1989 | (EP) . |
| 0393813 | 10/1990 | (EP) . |
| 0410621 | 1/1991 | (EP) . |
| 0248404 | 12/1991 | (EP) . |
| 0109408 | 8/1992 | (EP) . |
| 0628972 | 12/1994 | (EP) . |
| 0526081 | 5/1996 | (EP) . |
| 0668978 | 1/1997 | (EP) . |
| 2128394 | 4/1984 | (GB) . |
| 2262287 | 6/1993 | (GB) . |
| 57018-744 | 1/1982 | (JP) . |
| WO 94/10497 | 5/1994 | (WO) . |
| WO 96/25748 | 8/1996 | (WO) . |

* cited by examiner

*Primary Examiner*—Dean A. Reichard
*Assistant Examiner*—Chau N. Nguyen
(74) *Attorney, Agent, or Firm*—Lahive & Cockfield, LLP

(57) ABSTRACT

A screened non-coaxial communications cable comprising a plurality of cores through which communications signals can be transmitted. Each core comprises a metallic conductor surrounded by a close-fitting sleeve of insulating material that is substantially free of halogenated polymers. The insulating material has a permittivity of no greater than 3, and is constituted by or contains a layer of foamed polymer. In the region of the insulating material immediately adjacent the metallic conductor, the polymer contains no fire retardant metal hydroxide and/or carbonate layer disposed radially outwardly of and surrounding the plurality of cores. A first fire protection layer comprises a fabric formed from inorganic fibres. A second fire protection layer is disposed radially outwardly of and surrounding the first fire protection layer, and is formed from an extrudable polymer containing a fire retardant metal hydroxide and/or carbonate filler. The first and second fire protection layers are not adhesively bonded together. A metallic or metallized screening layer is disposed between the cores and the second fire protection layer.

45 Claims, 2 Drawing Sheets

COMMUNICATIONS CABLE

BACKGROUND OF THE INVENTION

This invention relates to a communications cable, and more particularly to a fire resistant communications cable.

Communications cables, such as cables used in telephone lines, typically consist of insulated copper cores, the layer surrounding the copper being formed from an insulating polymeric material. The insulated cores may be arranged in the form of twisted pairs or quads and a plurality of twisted pairs or quads may be bundled together and encased within an outer polymeric layer. A screening layer can be interposed between the bundled cores and the outer layer to serve as an earth.

One problem facing the manufacturers of cables is that the polymeric materials from which cables are formed represent a possible means by which fires can be transmitted through a building because commonly used polymers such as polyolefins (e.g. polyethylene or polypropylene) can be highly flammable in a fire situation. It is therefore known to make cables from a fire resistant material.

One test used to determine the fire resistance of cables is the so called Steiner Tunnel test (American National Standards Institute ANSI UL 910). The purpose of this test is to determine the flame-propagation distance and optical smoke density for electrical cables that are to be installed in ducts, plenums and other communications spaces and channels within buildings. This test is effectively mandatory in the USA for cables which are to be installed in buildings.

The test involves mounting the cable in a specially designed tunnel or chamber and subjecting the cable to a test fire fuelled by methane gas. An array of thermocouples is used to monitor the propagation of the flame along the cable and a photoelectric cell is used to monitor the density of the smoke created by the resulting fire. In order to meet the requirements of the test, the following criteria must be satisfied:

(a) The maximum flame propagation distance must not be greater than 5 feet (152 cm) beyond the initial test flame.

(b) The peak optical density of the smoke produced is to be 0.50 or less (32% light transmission).

(c) The average optical density of the smoke produced is to be 0.15 or less.

Polymeric insulating materials typically used for covering copper cores in electrical and communications cables include polyolefins such as polyethylene and polypropylene, which are highly flammable in fire situations. In order to overcome this problem, it has been proposed to use as the insulating polymer, a polymer composition which has better fire resistance or fire retardant properties. This approach is exemplified by DE-C-3044871 which discloses a cable in which individual metal conductors are covered with a layer of a fire retardant filled polyvinylchloride.

EP-B-0107796 discloses an optical communications cable in which the optical fibre is encased in a sheath or layer of a fire retardant polyolefin copolymer such as EVA filled with a metal hydroxide, an outer sheath of a similar fire retardant polymer also being provided.

EP-B-0526081 discloses electric and communications cables in which a tape of flexible mineral material is wrapped around the core, the tape being adhesively bonded to an outer layer of a fire retardant filled polymer which forms a char when exposed to a fire situation. The purpose of bonding the tape to the outer layer is to ensure that the char remains as a cohesive protective layer and does not fall away from the cable.

EP-0268827 discloses a fire-resistant electrical cable comprising a conductor surrounded by an insulating layer which in turn is surrounded by a tape-wrap layer which can be formed from metal, woven glass fibre, polyimide, polyimidine, or aromatic polyamide tape having an adhesive on its inner surface.

DE-A-3833597 discloses a fire resistant cable comprising a conductor surrounded by a thin layer of high temperature resistant polymer such as a polyesterimide, a polyetherimide, a polyamidimide or a polyimide, and a thicker outer layer of a non-high temperature stable polymer which is filled with a substance such a aluminium hydroxide.

WO-A-96/25748 discloses a fire resistant cable construction in which the conductor is surrounded by an inner layer of a foamed polymeric material such as polyolefin, a polyolefin copolymer or a polyurethane which preferably contains a fire retarding agent such as magnesium hydroxide. The inner layer in turn is surrounded by a halogenated polymeric layer which also contains a fire retardant additive such as magnesium hydroxide.

U.S. Pat. No. 4,810,835 discloses a coaxial cable in which the conductor is surrounded sequentially by concentric layers of an insulating material, a screening layer, a metallised fibre glass cloth layer and an outer layer of an insulating material.

GB-A-2128394 discloses an electrical cable in which the metal conductor is surrounded by a polymeric insulating material which is filled with inorganic fire retardant agents such as aluminium trihydrate and antimony pentoxide.

Of fundamental importance to the acceptability of communications cables are the electrical properties of the cable, and the typical properties that communications cables should possess are summarised in WO-A-96/25748. One important property is the dielectric constant or permittivity of the insulating material surrounding the conductor wire, which is a measure of the insulating capability of the material. In general, the higher the permittivity of the insulating material, the thicker the insulating material needs to be in order to provide the required characteristic impedance.

The permittivity of polyethylene is approximately 2.3 which makes it an excellent insulating material but, as pointed out above, polyethylene is flammable. Replacing polyethylene with polymer compositions containing fire retarding agents, as disclosed in the documents referred to above, whilst potentially offering improved fire resistance, would be detrimental to the electrical properties and in particular would lead to increased permittivity and therefore the required size of the core.

In order to provide improved fire resistance properties without sacrificing the electrical properties of the insulating material, fluorinated ethylene-propylene polymers (FEP) have been used as the insulation materials for metal conductors. Bundled FEP cores encased within an outer cable sheath formed from a filled fire resistant polymer are understood to have passed the Steiner Tunnel Test; indeed, it is understood by the present applicants that cables of such construction are the only communications cables to have passed the test prior to the present invention being made. However, a major problem with FEP, as stated in WO-A-96/25748, is that it is expensive and often in short supply. Moreover, it is understood that the thermal breakdown products of such fluorinated polymers are toxic.

It is clearly undesirable from a manufacturer's view for the basic raw materials for its products to be difficult and expensive to obtain. It is also undesirable to use a material where the breakdown products of the polymer are toxic fluorine-containing gases. An object of the present invention therefore is to provide a cable in which the need to use fluorinated polymers for the insulation of cable cores is avoided.

SUMMARY OF THE INVENTION

The communications cable of the invention comprises a core through which communications signals can be transmitted. The core comprises a metallic conductor surrounded by a layer of insulating material, the insulating material having a permittivity of no greater than 3. A first fire protection layer comprising a fabric formed from inorganic fibres is disposed radially outwardly of and surrounds the core. A second fire protection layer, formed from an extrudable polymer containing a fire retardant metal hydroxide and/or carbonate filler, is disposed radially outwardly of and surrounds the first fire protection layer. In accordance with the invention, the first and second fire protection layers are not adhesively bonded together.

It has unexpectedly been found that by using a combination of an outer layer of a fire resistant filled polymer containing a metal hydroxide or carbonate filler, and a layer of a fabric formed from inorganic fibres such as glass fibres disposed radially inwardly of the filled polymer layer, it is possible to maintain the fire resistance properties of the cable without needing to use fluorinated polymers as the insulation material for the metal conducting cores of the cable. In fact relatively flammable materials such as foamed polyolefins, which have improved insulating properties, can be used to surround the metal conducting cores. More particularly, it has been found that such cables, and in particular screened non-coaxial communications cables, of the aforesaid structure can satisfy the stringent requirements of the Steiner tunnel test.

Accordingly, in one particular aspect, the invention provides a screened non-coaxial communications cable comprising:

- a plurality of cores through which communications signals can be transmitted, each core comprising a metallic conductor surrounded by a close-fitting sleeve of insulating material which is substantially free of halogenated polymers, the insulating material having a permittivity of no greater than 3, and being constituted by or containing a layer of foamed polymer, and wherein at least in the region of the insulating material immediately adjacent the metallic conductor, the polymer contains no fire retardant metal hydroxide and/or carbonate filler;
- a first fire protection layer disposed radially outwardly of and surrounding the plurality of cores, the first fire protection layer comprising a fabric formed from inorganic fibres;
- a second fire protection layer disposed radially outwardly of and surrounding the first fire protection layer, the second fire protection layer being formed from an extrudable polymer containing a fire retardant metal hydroxide and/or carbonate filler, the first and second fire protection layers not being adhesively bonded together; and
- a metallic or metallised screening layer disposed between the cores and the second fire protection layer.

The inorganic fibres from which the fabric of the first fire protection layer is formed are preferably glass fibres, and the fabric is most preferably in the form of a woven glass fibre fabric. The fabric can be coated with a binder to prevent or reduce dislodgement of fibres from the fabric. An example of a suitable binder material is a silicone elastomer material.

The first fire protection layer is advantageously in the form of a tape, which is most preferably longitudinally wrapped, optionally having a very small degree of twist over an extended distance. Alternatively, the first fire protection layer can be helically or spirally wrapped.

The second fire protection layer is formed from an extrudable polymer containing a fire retardant metal hydroxide and/or carbonate filler such as aluminium hydroxide, alkaline earth metal hydroxides or carbonates such as magnesium hydroxide, calcium carbonate or magnesium carbonate, or mixtures thereof. The metal hydroxide/carbonate filler will usually be present in an amount corresponding to 10 to 100 parts by weight per 100 parts of the extrudable polymer,more usually 20 to 50 parts per 100 parts of polymer, for example 35 to 45 parts per 100 parts of the polymer. In a preferred embodiment, the metal hydroxide/carbonate filler is present in an amount corresponding to approximately 40 parts per 100 parts of the polymer.

The extrudable polymer can be a chlorinated polymer such as polyvinylchloride (PVC), or a non-halogenated polymer, for example a polyolefin such as polyethylene or polypropylene, or an ethylene or propylene copolymer such as ethylene-vinyl acetate (EVA). The extrudable polymer may contain a plasticiser, which may be present at relatively high levels. For example, the plasticiser can be present in an amount corresponding to between 10 and 60 parts by weight per 100 parts of polymer. More usually the plasticiser will be present in an amount corresponding to 40 to 50 parts by weight, for example approximately 45 parts by weight, per 100 parts of the polymer.

One group of preferred plasticisers are the phosphate plasticisers, for example polyphosphates such as melamine polyphosphate or ammonium polyphosphate.

In addition to the metal hydroxide/carbonate filler and plasticiser, the extrudable polymer can contain auxiliary fire retardant materials such as antimony compounds (e.g. antimony trioxide and antimony halides) and fire retardant bromine compounds, one preferred example of an auxiliary fire retardant compound being antimony bromide.

An example of a commercially available polymeric material suitable for use as second fire protection layer is the "Smokeguard II 600, 6001 or 800" material manufactured by the Gary Corporation of Leominster Mass., USA.

In general a communications cable will comprise a plurality of cores surrounded by the first fire protection layer. Each of the cores will have an insulating layer and the insulated cores typically will be arranged in the form of one or more twisted pairs or quads. There may be from one to thirty twisted pairs or quads. For example, there may be two, three, four, five or more twisted pairs or quads, and in one preferred embodiment, there are four such twisted pairs. For each twisted pair or quad, the lay length or pitch of the wires will be substantially constant along its length and, in order to minimise "cross-talk" between adjacent pairs or quads, the lay lengths or pitches of adjacent twisted pairs or quads in a bundle will be different.

The metallic conductor is typically formed from copper or silver or tin coated copper. Each metallic conductor is insulated in a polymeric insulating material. In accordance with the invention, the layer of insulating material around the conductor is preferably substantially free of fluorinated polymers, and more preferably is substantially free of halogenated polymers.

The layer of insulating material of the core preferably is formed from polyolefins such as polyethylene or polypropylene, and the polyolefin advantageously comprises a combination of a radially inner foam layer and a radially outer non-foamed layer or a combination of a radially inner non-foamed layer, an intermediate foamed layer, and a radially outer non-foamed layer.

The advantage of providing a foamed polyolefin layer is that the gas bubbles in the foam reduce the permittivity of the material thereby enabling thinner layers of insulating material to be used.

The radially outer non-foamed polyolefin layer can optionally contain one or more fire retardant fillers such as metal hydroxides and/or carbonates or other fire retardant additives as hereinbefore defined.

A screening layer can be interposed between the core or cores and the second fire protection layer, preferably together with a drain wire or conductor to allow the screening layer to be earthed at either end when the cable is installed and to compensate for any breaks or discontinuities in the screening layer. The screening layer is typically a metallic or metallised screening layer which can be formed for example from a metallised polymer film. For example, the screening layer can comprise a polymer film (such as a polyester film) coated with aluminium.

As with the first fire protection layer, the screening layer is advantageously in the form of a tape, which is most preferably longitudinally wrapped, although it may instead be helically or spirally wrapped.

BRIEF DESCRIPTION OF THE DRAWINGS

The invention will now be illustrated, but not limited, by reference to the particular embodiments shown in the accompanying drawings of which.

DETAILED DESCRIPTION OF THE INVENTION

Figure 1:
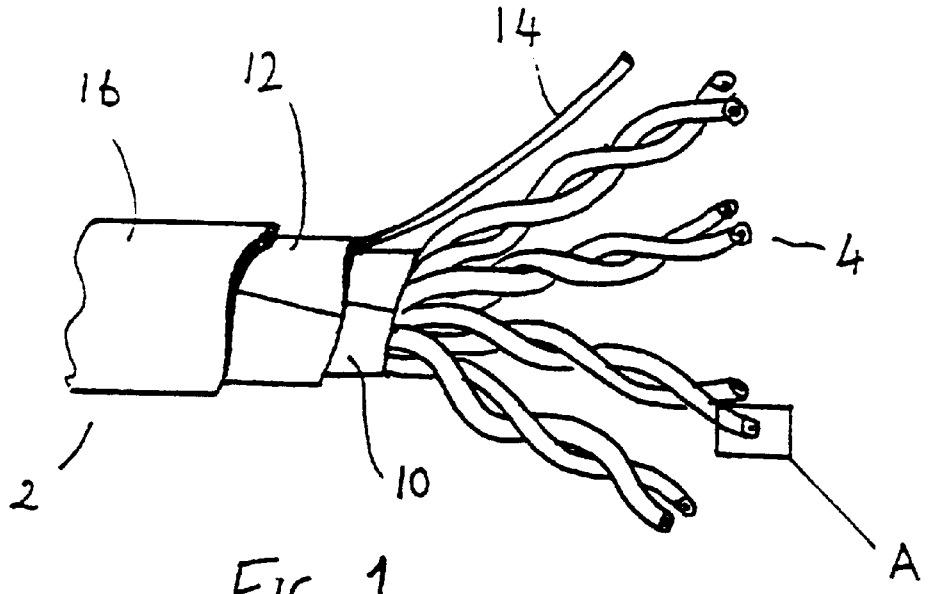
FIG. 1 is a view of an end of a cable according to one embodiment of the invention in which the various layers have been cut away to reveal the structure of the cable.
Figure 2:
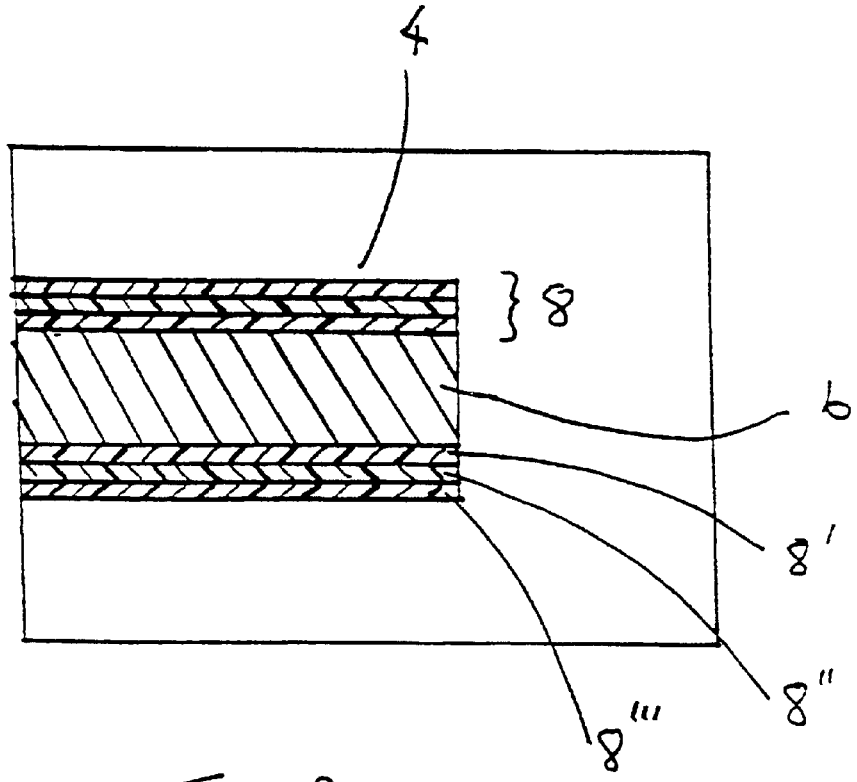
FIG. 2 is an enlarged longitudinal sectional view of the region marked A in FIG. 2.

Referring now to FIGS. 1 and 2, a cable 2 according to a first embodiment of the invention comprises a plurality of cores 4 through which electronic communications signals can be transmitted. Each core consists of a copper wire 6 surrounded by a layer 8 of a polyolefin (in this case polyethylene) insulating material. The polyolefin layer is of substantially uniform thickness along its length and is concentrically arranged with respect to the wire 6. The concentricity of the insulating layer and its relatively uniform thickness means that the spacing between the wires in the pairs or quads remain substantially uniform throughout the length of the cable thereby ensuring a substantially constant characteristic impedance. The structure of the layer 8 is shown more clearly in FIG. 2 from which it can be seen that the layer has a radially inner layer 8' of a non-foamed polyolefin, an intermediate layer 8" of a foamed polyolefin, and a radially outer layer of a non-foamed polyolefin 8'''. The advantage of the foamed layer, as indicated above is that the gas bubbles within the foam have reduced permittivity relative to the solid polymer thereby enabling the overall thickness of the insulation layer to be reduced. The polyolefin (e.g. polyethylene or polypropylene) is layered onto the wire 6 by means of a combination of extruders and the foamed layer is formed by introducing nitrogen or another inert gas into the polyolefin before extruding onto the wire 6.

In the embodiment shown there are eight cores in total, arranged in four twisted pairs, each of the four pairs having a different number of turns per unit length (different pitch) in conventional fashion in order to minimise lateral transmission of signals ("cross-talk") between adjacent pairs of cables.

Surrounding the bundled cores 4 is the first fire protection layer 10 which consists of a woven fibre glass tape which is wrapped about the bundled cores so that the longitudinal edges of the tape overlap. The tape 10 is impregnated or coated with a silicone elastomer material to prevent the fibres from fraying and being dislodged from the fabric. A suitable fabric is "Megotape" which can be obtained from Lindsay & Williams of Warrington UK.

Surrounding the first fire protection layer 10 is a layer 12 of an aluminised polyester tape which functions as an earth or screening layer preventing extraneous electrical signals from interfering with signals passing along the cable. The screening layer 12 can be, for example, up to about 100 micrometres in thickness, and a suitable grade of material is a material having a composite thickness of 62 micrometres (50 micrometres aluminium and 12 micrometres polyester) available from Polifibra. In order to ensure continuity and to compensate for any breaks in the screening layer 12, a conductor or drain wire 14 formed from silver or tin coated copper is disposed between the screening layer 12 and the first fire protection layer 10. The drain wire 14 can be connected to earth at both ends of the cable during installation. The copper wire 14 is coated with silver or tin in order to prevent a galvanic corrosion action taking place between the aluminium of the screening layer and the copper.

Surrounding the screening layer 12 is the second fire protection layer 16 which is in the form of an extruded layer of a fire resistant polymer which in this embodiment is a filled polyvinylchloride (PVC). In order to provide fire resistance, the polymer is filled with 40 parts of metal hydroxide, which is either aluminium trihydroxide or magnesium hydroxide or a mixture of the two, per hundred parts of the PVC. The PVC also contains 45 parts of a phosphate plasticiser and 0.5 parts of an antimony bromide fire retarding agent per 100 parts of the PVC. A suitable filled polymer is the "Smokeguard 6001" material available from the Gary Corporation in Mass. USA, or Evode PLC in the UK.

EXAMPLE

A specific example of a cable constructed generally as shown in FIGS. 1 and 2 and as described above, but differing very slightly with regard to the arrangement of the foamed and non-foamed layers in the cores, has eight cores making up four twisted pairs, each core being of 1.02 mm nominal diameter. Each core has a 0.53 mm copper conductor wire encased within a 0.245 mm layer of polyethylene insulation which consists of a 50 micrometre thick outer skin with the remainder of the thickness being constituted by an underlying foamed polyethylene layer. The bundled cores are surrounded by a 0.1 mm thick layer of "Megotape" which in turn is surrounded by an aluminised polyester screening layer (Polifibra) having a backing layer of 12 micrometre thick polyester and an aluminium layer 40 micrometres in thickness. A drain wire of 0.5 mm diameter tinned copper wire is interposed between the screening layer and the "Megotape". The outermost second fire protection layer is constituted by a 0.6 mm thick layer of "Smokeguard II 6001 " filled polymer from Gary Corporation, of the Leominster Mass., USA.

Samples of cable made up in accordance with the example were subjected to the Steiner tunnel test in accordance with American National Standard ANSI/UL 910-1994 by Inchcape Testing Services NA Inc, of Copland N.Y. U.S.A. The results of two test combustions are set out in Table 1 below.

TABLE 1

| Test | Sample 1 | Sample 2 | Standard Required |
|---|---|---|---|
| Flame Propagation Distance (feet) | 4.0 | 4.7 | 5.0 |
| Peak Optical Density | 0.316 | 0.434 | 0.50 |
| Average Optical Density | 0.060 | 0.080 | 0.15 |

The results set forth in the table demonstrate that cables in accordance with the invention are capable of meeting the exacting standards required by the Steiner tunnel test, a test which is of great importance in determining whether or not communications cables are acceptable for use in cavities and communications channels such as the plenum spaces above false ceilings in buildings.

Figure 3:
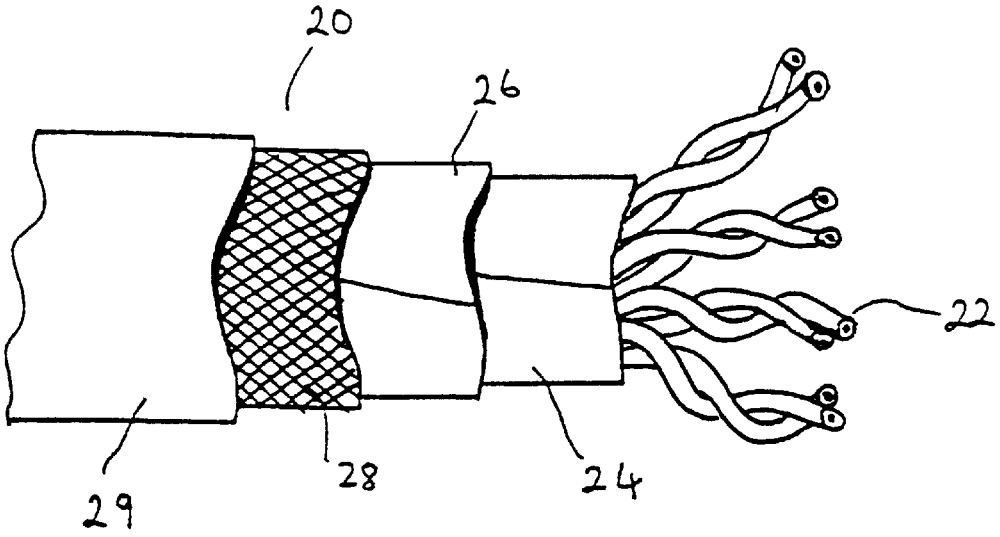
FIG. 3 is a view of an end of a cable according to a second embodiment of the invention in which the various layers have been cut away to reveal the structure of the cable.

A second embodiment of the invention is shown in FIG. 3. According to this embodiment, the cable 20 comprises four twisted pairs 22 having the same composition and structure as shown in FIGS. 1 and 2 above, the bundle of twisted pairs 22 being encased within the first fire protection layer 24 which consists of the woven fibre glass tape referred to in respect of FIGS. 1 and 2. Surrounding the first fire protection layer is a layer 26 of an aluminised polyester tape similar to that used in the first embodiment but with the aluminium facing outwards rather than inwards. Instead of a drain wire, a copper braid 28 is arranged around the tape 26, and around the copper braid is disposed the second fire protection layer 29 which can have the same composition as the corresponding layer in the first embodiment described above.

Figure 4:
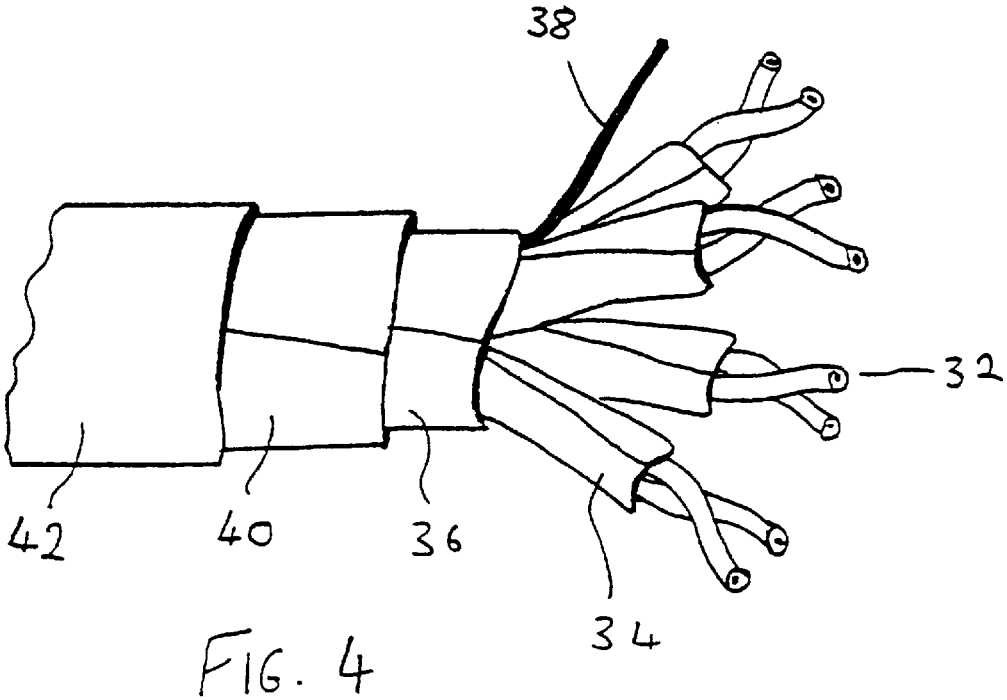
FIG. 4 is a view of an end of a cable according to a third embodiment of the invention in which the various layers have been cut away to reveal the structure of the cable.

A third embodiment of the invention is shown in FIG. 4. In this embodiment, the cable 30 comprises four twisted pairs 32 of the same composition as the first and second embodiments, but in this embodiment, each of the twisted pairs is individually wrapped in a screening layer 34 of an aluminised polyester tape, the aluminium surface of which faces outwardly. The bundle of wrapped pairs 32/34 in turn is surrounded by a further screening layer of aluminised polyester tape 36 in which the aluminium layer faces inwardly. A drain wire 38 of tin coated copper is disposed between the tape 36 and the individually wrapped pairs 32/34 so as to be in contact with the aluminium surfaces of both the tape 36 and the tapes 34. Disposed radially outwardly of and surrounding the screening layer 36 are first and second fire protection layers 40 and 42 respectively which have compositions corresponding to the fire protection layers of the first and second embodiments.

In this embodiment, the outer screening layer 36, instead of comprising an aluminised polyester tape, could take the form of a copper braid of the type shown in FIG. 3.

Although the invention has been illustrated by reference to three specific embodiments, it will readily be apparent that the principle of using a combination of an outer fire resistant polymer layer and an inner layer formed from a fabric made from inorganic fibres such as glass fibres can be applied to communications cables of differing configurations. It will also be readily apparent that numerous modifications and alterations can be made to the cables illustrated above without departing from the principles underlying the invention and all such modifications and alterations are intended to be embraced by this application.

What is claimed is:

1. A screened non-coaxial communications cable comprising:

a plurality of cores through which communications signals can be transmitted, each core including a metallic conductor surrounded by a close-fitting sleeve of insulating material which is substantially free of halogenated polymers, the insulating material having a permittivity of no greater than 3, and being constituted by or containing a layer of foamed polymer, and wherein at least in the region of the insulating material immediately adjacent the metallic conductor, the insulating material is free of at least one of fire retardant metal hydroxide and carbonate filler;

a first fire protection layer disposed radially outwardly of and surrounding the plurality of cores, the first fire protection layer having a fabric formed from inorganic fibres;

a second fire protection layer disposed radially outwardly of and surrounding the first fire protection layer, the second fire protection layer being formed from an extrudable polymer containing at least one of a fire retardant metal hydroxide and a carbonate filler, the first and second fire protection layers not being adhesively bonded together; and a metallic or metallized screening layer disposed between the cores and the second fire protection layer.

2. A communications cable according to claim 1 wherein the inorganic fibres are glass fibres.

3. A communications cable according to claim 2 wherein the fabric is a woven glass fibre fabric.

4. A communications cable according to claim 2 wherein the fabric is coated with a binder to prevent or reduce dislodgement of said fibres from the fabric.

5. A communications cable according to claim 4 wherein the binder is a silicone elastomer.

6. A communications cable according to claim 1 wherein the fabric constituting the first fire protection layer is not metallized on either surface thereof.

7. A communications cable according to claim 1 wherein there is present only one said first fire protection layer.

8. A communications cable according to claim 1 wherein the insulating material surrounding each metallic conductor includes a radially inner layer and a radially outer layer, the radially inner layer being formed by said layer of foamed polymer, and the radially outer layer being a non-foamed layer.

9. A communications cable according to claim 8 wherein the outer non-foamed layer contains one or more fire retarding compounds.

10. A communications cable according to claim 9 wherein the outer non-foamed layer contains at least one of a metal hydroxide and a metal carbonate fire retardant.

11. A communications cable according to claim 1, wherein the insulating material comprises a radially inner layer, an intermediate layer, and a radially outer layer, wherein said layer of foamed polymer forms said intermediate layer, and wherein said radially inner layer and radially outer layer are non-foamed layers.

12. A communications cable according to claim 1 wherein the insulating material of the core is a polyolefin.

13. A communications cable according to claim 12, wherein the polyolefin comprises a radially inner layer and a radially outer layer, and wherein said layer of foamed polymer forms said radially inner layer, and said radially outer layer is a non-foamed layer.

14. A communications cable according to claim 12 wherein the polyolefin comprises a radially inner layer, an intermediate layer, and a radially outer layer, said layer of foamed polymer forming said intermediate layer, and said radially inner and radially outer layers being non-foamed layers.

15. A communications cable according to claim 1 wherein the first fire protection layer is in the form of a tape, which is longitudinally, spirally or helically wrapped.

16. A communications cable according to claim 1 wherein the cores are arranged in the form of one or more twisted pairs or quads.

17. A communications cable according to claim 16 wherein the cores are arranged in the form of a plurality of twisted pairs or quads.

18. A communications cable according to claim 16 wherein the cores comprise from one to thirty of said twisted pairs or quads.

19. A communications cable according to claim 18 wherein the cores comprise four of said twisted pairs.

20. A communications cable according to claim 16, wherein each twisted pair or quad is individually wrapped in a separate screening layer.

21. A communications cable according to claim 1 wherein the screening layer is interposed between the first and second fire protection layers.

22. A communications cable according to claim 21 wherein the screening layer is formed from a metallized polymer film.

23. A communications cable according to claim 22 wherein the polymer film is coated with aluminum.

24. A communications cable according to claim 22 wherein the polymer film is formed from a polyester.

25. A communications cable according to claim 21 wherein a drain wire is interposed between the cores and the second fire protection layer so as to contact the screening layer.

26. A communications cable according to claim 25 wherein a metal surface of the screening layer faces radially inwardly and the drain wire is disposed radially inwardly of the screening layer.

27. A communications cable according to claim 21 wherein a metallic braid is disposed between the cores and the second fire protection layer so as to contact a metallic surface of the screening layer.

28. A communications cable according to claim 27 wherein the metallic surface faces radially outwardly and the metallic braid is disposed radially outwardly of the screening layer.

29. A communications cable according to claim 1 wherein the screening layer is interposed between the plurality of cores and the first fire protection layer.

30. A communications cable according to claim 1 wherein each core is individually wrapped in a separated screening layer.

31. A communications cable according to claim 30 wherein the plurality of individually wrapped cores form a bundle and the bundle is surrounded by a second metallic or metallized screening layer.

32. A communications cable according to claim 1 wherein the fire retardant metal hydroxide filler is at least one of magnesium hydroxide and aluminum hydroxide.

33. A communications cable according to claim 1 wherein there are present 10 to 100 parts of the metal hydroxide or carbonate filler per 100 parts of the extrudable polymer.

34. A communications cable according to claim 33 wherein there are present 20 to 50 parts of the metal hydroxide or carbonate filler per 100 parts of the extrudable polymer.

35. A communications cable according to claim 34 wherein there are present 35 to 45 parts of the metal hydroxide or carbonate filler per 100 parts of the extrudable polymer.

36. A communications cable according to claim 35 wherein there are present approximately 40 parts of the metal hydroxide filler per 100 parts of the extrudable polymer.

37. A communications cable according to claim 1 wherein the extrudable polymer contains a plasticizer.

38. A communications cable according to claim 37 wherein the plasticizer is present in an amount corresponding to 10 to 60 parts per 100 parts of the extrudable polymer.

39. A communications cable according to claim 38 wherein the plasticizer is present in an amount corresponding to 22 to 55 parts per 100 parts of the extrudable polymer.

40. A communications cable according to claim 39 wherein the plasticizer is present in an amount corresponding to 40 to 50 parts per 100 parts of the extrudable polymer.

41. A communications cable according to claim 40 wherein the plasticizer is present in an amount corresponding to approximately 45 parts per 100 parts of extrudable polymer.

42. A communications cable according to claim 37, wherein the plasticizer is a phosphate.

43. A communications cable according to claim 1 wherein the extrudable polymer contains a fire retardant antimony compound.

44. A communications cable according to claim 43 wherein the extudable polymer contains an antimony bromide fire retardant compound.

45. A communications cable according to claim 1 wherein the extrudable polymer contains a fire retardant bromine compound.

* * * * *